US008471621B2

(12) United States Patent
Mailand et al.

(10) Patent No.: US 8,471,621 B2
(45) Date of Patent: Jun. 25, 2013

(54) CIRCUIT AND METHOD FOR PERFORMING ARITHMETIC OPERATIONS ON CURRENT SIGNALS

(75) Inventors: Marko Mailand, Dresden (DE); Stefan Getzlaff, Käbschütztal (DE)

(73) Assignee: Zentrum Mikroelektronik Dresden AG, Dresden (DE)

( * ) Notice: Subject to any disclaimer, the term of this patent is extended or adjusted under 35 U.S.C. 154(b) by 0 days.

(21) Appl. No.: 13/458,118

(22) Filed: Apr. 27, 2012

(65) Prior Publication Data

US 2012/0293229 A1 Nov. 22, 2012

(30) Foreign Application Priority Data

Apr. 28, 2011 (EP) ..... 11164023

(51) Int. Cl.
*G06F 7/42* (2006.01)

(52) U.S. Cl.
USPC ..... 327/361; 327/124; 327/355

(58) Field of Classification Search
USPC ..... 327/124, 355, 361
See application file for complete search history.

(56) References Cited

U.S. PATENT DOCUMENTS 5,337,230 A * 8/1994 Baumgartner et al. ..... 700/9
5,382,956 A * 1/1995 Baumgartner et al. ..... 341/155
5,467,090 A * 11/1995 Baumgartner et al. ..... 341/155
6,330,464 B1 12/2001 Colvin, Jr. et al.
7,289,836 B2 10/2007 Colvin, Jr.
7,615,973 B2 * 11/2009 Uehara ..... 323/224

FOREIGN PATENT DOCUMENTS

CA 2480608 9/2005
EP 0579751 B1 6/2011

OTHER PUBLICATIONS

"A CMOS Tunable Transimpedance Amplifier," Hwang et al., IEEE Microwave and Wireless Component Letters, vol. 16, No. 12, Dec. 2006.

"A new correlated double sampling (CDS) technique for low voltage design environments in advanced CMOS Technology," Chen Xu, ShenChao, Mansun Chan, ESSCIRC, Sep. 2002.

"Correlated double sample design for CMOS image readout IC", Gao Junet al., 7th International IEEE Conference on Solid-State and Integrated Circuits Technology (2004).

* cited by examiner

*Primary Examiner* — Kenneth B. Wells
(74) *Attorney, Agent, or Firm* — Heslin Rothenberg Farley & Mesiti P.C.

(57) ABSTRACT

A circuit for performing arithmetic operations includes a differential capacitive transimpedance amplifier (CTIA) and a cross-multiplexer. The cross multiplexer forwards the current to be integrated out of a plurality of current sources either to the positive input port of the differential CTIA for positive integration in direct mode or to the negative input port of the differential CTIA for negative integration in reverse mode.

10 Claims, 2 Drawing Sheets

CIRCUIT AND METHOD FOR PERFORMING ARITHMETIC OPERATIONS ON CURRENT SIGNALS

CROSS REFERENCE TO RELATED APPLICATIONS

This application claims priority to European application No. 11164023.1 filed on Apr. 28, 2011, the entire contents of which is hereby incorporated herein by reference.

TECHNICAL FIELD

The present invention relates to a circuit and method for performing arithmetic operations on current signals. The present invention specifically relates to a circuit and method for difference measurement and transimpedance amplification of separate current signals.

BACKGROUND ART

In discrete and integrated analog/mixed-signal circuits, signal sources can provide currents for which the difference carries certain sensor information. Specifically, in optical sensor systems where a light intensity difference must be measured, separate photo diodes with different spectral sensitivity or geometrical orientation provide light-intensity-proportional currents and can therefore be interpreted as a current source in this sense. The information of interest lies within the difference of these current signals.

U.S. Pat. No. 6,330,464 B1 and U.S. Pat. No. 7,289,836 B2 relate to an optical-based sensor for detecting the presence or amount of analyte using both indicator and reference channels. The sensor has a sensor body with an embedded source of radiation. Radiation emitted by the source interacts with the indicator membrane's molecules proximate the surface of the body. At least one optical characteristic of these indicator molecules varies with the analyte concentration. Radiation emitted or reflected by these indicator molecules enters and is internally reflected in the sensor body. Photosensitive elements within the sensor body generate both the indicator channel and reference channel signals to provide an accurate indication of concentration of the analyte. The difference between the two signals is utilized after their digitization.

Usually small photo currents must be processed. These small currents need to be amplified, which is typically done by a low-noise transimpedance amplifier (TIA). The TIA can provide output signals (e.g.) up to a finite level which is the saturation limit or the saturation voltage. Signals that go beyond this saturation limit will be clipped and thus distorted which prevents full-scale signal processing and therefore must be circumvented.

CA 2480608 relates to an elevated front-end amplifier offering low-noise performance while providing a wide dynamic range that is employed for amplifying the weak photo current received from a photo detector.

EP 0579751 B1 relates to a wideband TIA utilizing a differential amplifier circuit structure in which the differential pair is bridged by a signal detector that is the photo detector when the TIA is implemented within an optical receiver. In order to bias the signal detector, the differential pair is operated asymmetrically with respect to the DC voltage, but the circuit maintains a symmetric AC response to the signal detector current input. The circuit is designed to operate at the unity gain frequency. The signal detector is placed between the source (or emitter) electrodes of the transistors which helps to reduce the impact of gate (or base) capacitance on circuit response speed. Combined, these factors maximize the bandwidth capabilities of the circuit. The circuit is responsive to a current input to produce two voltage outputs equal in magnitude but opposite in phase.

"A CMOS Tunable Transimpedance Amplifier," Hwang et al., IEEE Microwave and Wireless Component Letters, Vol. 16, No. 12Dec. 2006, relates to TIA that incorporates a mechanism for gain and bandwidth tuning. The TIA can be adjusted to achieve optimum performance with the lowest bit-error rate for high-speed applications.

"Low FPN High Gain Capacitive Transimpedance Amplifier for Low Noise CMOS Image Sensors", Boyd Fowler, Janusz Balicki, Dana How, and Michael Godfrey, Pixel Devices Intl. Inc. relates to a low fixed pattern noise capacitive transimpedance amplifier (CTIA) for active pixel CMOS image sensors with high switchable gain and low read noise.

In order to interpret the current signals, an analog-to-digital converted and thus a digitized version of the analog signal must be provided. As in U.S. Pat. No. 6,330,464 B1 and U.S. Pat. No. 7,289,836 B2, two separate digital measurements values are obtained and their digital difference is processed further. The device utilized for the digitization is typically an analog-to-digital converter (ADC), which is always limited by a maximum resolution and processable dynamic range. In systems as described in U.S. Pat. No. 6,330,464 B1 and U.S. Pat. No. 7,289,836 B2, using (e.g.) RFID-based ISO-protocol-compliant parts that are powered via energy harvesting and thus do not come with an independent power supply, the overall duration of communication combined with the need for power to encode and modulate, etc., require that a host-slave interaction being as infrequent as possible. This is also required for communication security: the less often and shorter, the better. Additionally, RFID systems can be very sensitive to RF distortions, which might prevent communication or even a complete host-slave interaction. For these reasons, the transmission of one measurement result will always be preferred to transmitting two or more results.

Moreover, there are techniques based on correlated double-sampling. Correlated double sampling makes use of a subsequent sample, in time or function, of a current across a capacitor used to integrate different currents from the same source for use in compensating for offsets and low frequency noise effects; e.g., compensating for the dark current component of a pixel-photodiode in the overall desired light detection signal.

"A new correlated double sampling (CDS) technique for low voltage design environments in advanced CMOS Technology," Chen Xu, ShenChao, Mansun Chan, ESSCIRC, September 2002, relates to a fixed-voltage-difference readout circuit implemented on a CMOS active pixel sensor.

"Correlated double sample design for CMOS image readout IC", Gao Junet al., $7^{th}$ International IEEE Conference on Solid-State and Integrated Circuits Technology (2004) relates to a two-amplifier state topology used for implementing a respective compensation method using a correlated double-sampling approach.

Because the A-D conversion is limited in dynamic range and is therefore also limited in the digital measurement results, the effective dynamic range and digital resolution, respectively, for the difference itself is less than for the individual signal current. The smaller the current signal's difference is, the less effective digital resolution is for the difference based on individually A-D converted separate current signals. Often a factor of 2 or less is present, for example, between a signal and reference current, which leads to a reduction of resolution of the signal of 1 bit or more.

Therefore, the problem arises of how to obtain an amplified, digitized difference between two separate current signals; whereas the full ADC resolution can be utilized to digitize the difference itself. If a TIA might be used as the processing element to resolving this problem, then it must be taken into consideration that the saturation limit of the TIA should not be reached throughout the whole processing time.

Moreover, the RF-transmission and especially the double A-D conversion typically consume more power than a single A-D conversion and respective measurement results transmission.

An additional problem lies in the limited absolute signal range and TIA gain in combination with the required gain to realize potential full-scale amplification. If the TIA gain is limited and a higher gain for the signal difference is required, single "saw-tooth-like" integration would not yield sufficient amplification. In this case, two subsequent single integration ramps with polar slope would lead to saturation and, hence, clipping of the individual current signal (current). Hence, the potential difference output would not be correct.

BRIEF SUMMARY OF THE INVENTION

It is an objective of the present invention to provide a circuit and related method for performing arithmetic operations on current signals that operates safely.

The present invention relates to a circuit comprising an input means configured to selectively receive a current from a plurality of currents; a first current mirror with mirror ratio m; a second current mirror; a third current mirror; a cross-multiplexer; and a differential capacitive transimpedance amplifier having the following:

a first capacitance and a first switching element connected in parallel to the negative input port and a first output port of the differential capacitive transimpedance amplifier and a second capacitance and second switching element connected in parallel to the positive input port and a second output port of the differential capacitive transimpedance amplifier;

the input means being connected to the input port of the first current mirror;

the output port of the first current mirror being connected the input ports of the second and third current mirror;

the output port of the second current mirror being connected to the first input port of the cross-multiplexer;

the output port of the third current mirror being connected to a second input port of the cross-multiplexer;

the first output port of the cross-multiplexer being connected to the negative port of the differential capacitive transimpedance amplifier and the second output port of the cross-multiplexer being connected to the positive port of the differential capacitive transimpedance amplifier;

the cross-multiplexer being configured either in direct mode, which establishes a first current path between its first input port and its first output port and a second current path between its second input port and its second output port or in reverse mode, which establishes a first current path between its first input port and its second output port and a second current path between its second input port and its first output port.

By means of the circuit according to the present invention, currents from the plurality of current sources can be integrated with different polarities by means of the capacitances depending on the selected mode for the cross multiplexer. For positive integration, the cross multiplexer operates in direct mode; for negative integration, the cross multiplexer operates in reverse mode.

The signal-related amplification and gain, respectively, is determined by the integration time $t_i$ and the circuit parameters: current mirror factor m and integration capacitance $C_{int}$. For a single signal the following equation holds:

$$G = t_i \cdot \frac{m}{C_{int}}$$

Thus, the current mirror factor, m and the integration time $t_i$ are the tuning parameters for each individual input current (input signal). Changing m and/or $t_i$ will lead to a changed coefficient for the analog superposition (signal processing). Moreover, silicon production's imperfections leading to current mirror mismatch effects can be compensated by additional adjustment of the integration time $t_i$ per signal source. Finally this enables the generation of very precise gains G being the scaling factor of the respective signal source.

If multiple (a times) integrations with different (polar) slopes lead to the generation of a signal (current) difference, the signal difference, $d=I_s-I_r$ as a function of $I_r$ and $V_{out}$, is determined by $$d = \frac{V_{out}}{a_r \cdot t_{ir} \cdot \frac{m_r}{C_{intr}}} + I_r \frac{\frac{m_r}{C_{intr}} \cdot t_{ir} - \frac{m_s}{C_{ints}} \cdot t_{is}}{\frac{m_r}{C_{intr}} \cdot t_{ir}}$$

with $V_{out}$ being the differential output voltage of the TIA that carries the (current) signal's difference information. Dependent on the application case, a pure difference or a difference plus some offset (second summand in the difference equation above) is of interest. If exactly only the difference is needed, the signal gain for the two (current) signals must be the same:

$$\frac{m_r}{C_{intr}} \cdot t_{ir} = \frac{m_s}{C_{ints}} \cdot t_{is} = \frac{m}{C} \cdot t_i$$

Thereby, $I_r$ is the base reference signal and the second signal $I_s$ is given by: $I_s=I_r+d$.

Here, the desired signal (i.e., the difference) can be described as:

$$d \sim v_{out} = \frac{m}{C} \cdot t_i (I_s - I_r)$$

One aspect of the present invention relates to the capacitances. They may be implemented as tunable devices or subcircuits in the sense that their capacitance is digitally programmable. This allows greater flexibility for changing the gain.

One aspect of the present invention relates to a plurality of input sources of the same kind. By increasing the input channels (e.g.) of the input multiplexer, a selectable superposition with selectable positive and negative slope can be realized.

One aspect of the present invention relates to external sources to the TIA circuit. The analog signal processing using the TIA remains the same for different sources. The input means may comprise a plurality of light-emitting diodes, a switching element being configured to selectively drive one light emitting diode out of the plurality of light emitting diodes, and a light sensitive element.

One aspect of the present invention relates to the output analog-to-digital converter of the circuit. The connection between the TIA's output and the output analog-to-digital converter may be implemented such that only negative differential signals from the TIA will be processed.

One aspect of the present invention relates to a circuit with additional capacitors used for additional capacitive voltage division to reduce the effective size of the capacitance in the feedback loop of the TIA. This allows the capacitance to be much larger than would otherwise be allowed by a high gain required for the TIA. A large value of the capacitance will be subject to smaller relative variations, which then must have a smaller effect on the TIA performance. Assuming cascode amplification, most of the gain fixed pattern noise in a capacitive TIA originates in variations in the feedback capacitors; consequently, large capacitors in the feedback loop reduce the gain fixed pattern noise.

Therefore, the circuit may also comprise a first, second, third, fourth, fifth, and sixth capacitor and a third and fourth switching element. The first capacitance consists of the first and second capacitor. One port of the third capacitor is connected to the first and second capacitor, and one port of the third capacitor is connected to ground. The second capacitance consists of the fourth and fifth capacitor. One port of the sixth capacitor is connected to the fourth and fifth capacitor, and one port of the sixth capacitor is connected to ground. The third switching element is arranged in parallel to the second capacitor, and the fourth switching element is arranged in parallel to the fifth capacitor.

The capacitive TIA may be operated in either the normal high gain mode or an additional low gain mode. In high gain mode, the third and fourth switching elements are switched during reset so as to allow the capacitive voltage divider consisting of the second and third capacitor to operate during charge integration. In low gain mode, the third and fourth switching elements are always on so as to shortcut the second and fifth capacitor.

The present invention further relates to a method for operating the circuit according to the present invention.

The input means is configured to receive a first current, the cross-multiplexer is configured to operate in direct mode, and the first and second switching elements are off so as to integrate the first current flowing into the first and second capacitance. If a second current is to be added to the first current, the input means is configured to receive the second current, the cross-multiplexer is configured to operate in direct mode, and the first and second switching elements are off so as to integrate the second current flowing into the first and second capacitance. If a second current is to be subtracted from the first current, the input means is configured to receive the second current, the cross-multiplexer is configured to operate in reverse mode, and the first and second switching elements are off so as to integrate with reverse polarity the second current flowing into the first and second capacitance.

Any weighted subtraction and addition (arbitrarily scaled for each source) can be represented by only setting up proper current mirror factors and controlling the integration time per source. Hence, a single amplification and a subsequent single A-D conversion can deliver any complex measure of the composition kind:

$$v_{out} = \sum_n (-1)^{n_x} \cdot a_n \cdot s_n$$

With n being the arbitrary number of signal sources $s_n$, which are individually weighted/scaled by the coefficient $a_n$. The term $(-1)^{n_x}$ determines if the contribution of the $n^{th}$ source to the overall desired result is obtained by a subtraction ($n_x$=1) or an addition ($n_x$=0) of the respective the source, $s_n$. This means that the output signal (e.g., the voltage $v_{out}$) of the TIA can be a linear superposition of arbitrary number of arbitrarily scaled (signal gain $\pm a_n$) input signals $s_n$ (e.g., input currents: $I_r$ and $I_s$).

With this general (unspecific) view, the proposed and presented method is a generally valid analog signal processing concept for subtraction and addition of various (different) input sources being scaled (amplified or attenuated) in order to convert exactly only the sum/difference of interest.

The connection between the amplifier's output and the post-processing elements (e.g., an ADC's input) may be implemented specifically so that only negative differential signals from the amplifier will be processed. In this case, it must be ensured that the first integrated signal (typically the reference signal channel) is lower than the second integrated signal (typically the desired signal channel), assuming the same gain for both signals and also that $I_{reference}<I_{signal}$ would fulfill this requirement. With individual gains for each signal, a potentially positive amplifier output voltage could be generated despite having put the reference signal first. Therefore, the individual gains must be set up carefully.

Regarding digitization of the amplifier output, the output code for the amplified difference result will be such that the highest ADC output code will equal the highest absolute difference signal and the smallest ADC code would refer to the lowest absolute value of the difference.

After performing one arithmetic operation on current signals, the circuit can be reset by switching the first and second switching elements so as to discharge the capacitances.

BRIEF DESCRIPTION OF THE DRAWINGS

The circuit and method according to the invention are described in more detail herein below by way of exemplary embodiments and with reference to the attached drawings, in which.

EMBODIMENTS OF THE INVENTION

Figure 1:
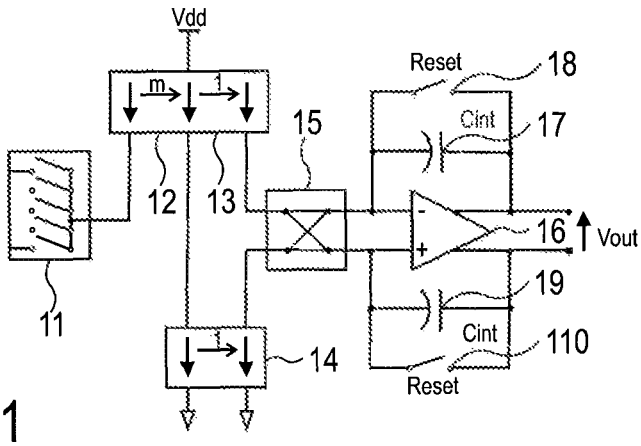
FIG. 1 shows a circuit according to the present invention.

FIG. 1 shows one embodiment of the circuit. The circuit comprises an input means 11 being configured to selectively receive a current from a plurality of currents; a first current mirror 12 with mirror ratio m; a second current mirror 13; a third current mirror 14; a cross-multiplexer 15; and a differential capacitive transimpedance amplifier 16. A first capacitance 17 and a first switching element 18 are connected in parallel to the negative input port and a first output port of the differential capacitive transimpedance amplifier 16. A second capacitance 19 and a second switching element 110 are connected in parallel to the positive input port and a second output port of the differential capacitive transimpedance amplifier 16. The input means 11 are connected to the input port of the first current mirror 12. The output port of the first current mirror 12 is connected the input ports of the second 13 and third 14 current mirror. The output port of the second current mirror 13 is connected to a first input port of the cross-multiplexer 15. The output port of the third current mirror 14 is connected to a second input port of the cross-multiplexer 15. The first output port of the cross-multiplexer 15 is connected to the negative port of the differential capacitive transimpedance amplifier 16, and the second output port of the cross-multiplexer 15 is connected to the positive port of the differential capacitive transimpedance amplifier 16. The cross-multiplexer 15 is configured for either direct mode or reverse mode. In direct mode, the cross-multiplexer establishes a first current path between its first input port and its first output port and a second current path between its second input port and its second output port. Alternatively, in reverse mode, the cross-multiplexer is configured to establish a first current path between its first input port and its second output port and a second current path between its second input port and its first output port.

Figure 2:
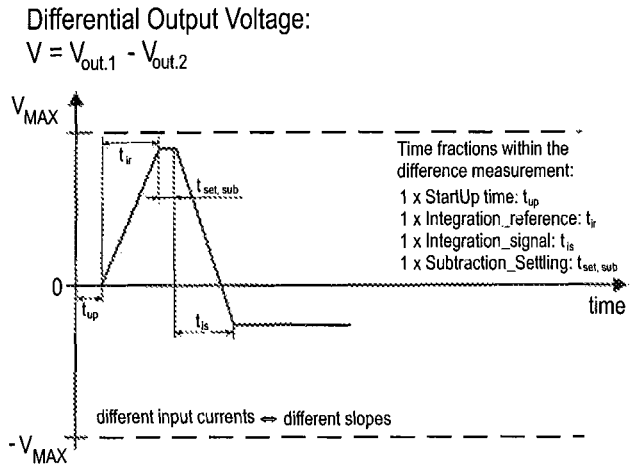
FIG. 2 shows a diagram of the differential output voltage.

Direct and reverse modes refer to polarity dependent integration of currents flowing into the capacitances as shown in FIG. 2. First the circuit is reset by switching the first (18) and second (110) switching elements. After a start-up time $t_{up}$, positive integration of the reference signal starts and is completed after $t_{ir}$. During the reference signal integration, the circuit operates in direct mode. The input means 11 is configured to receive the reference current. The cross-multiplexer 15 is configured to operate in direct mode and the first 18 and second 110 switching elements are off so that the reference current flowing into the first 17 and second capacitance 19 is integrated. Then, the circuit is set for subtraction where it operates in reverse mode. The time to set the circuit is $t_{set,sub}$. The input means 11 is configured to receive the integration current, the cross-multiplexer 15 is configured to operate in reverse mode, and the first 18 and second 110 switching elements are off so as to integrate with reverse polarity the integration current flowing into the first 17 and second capacitance 110 for the time $t_{is}$.

Figure 3:
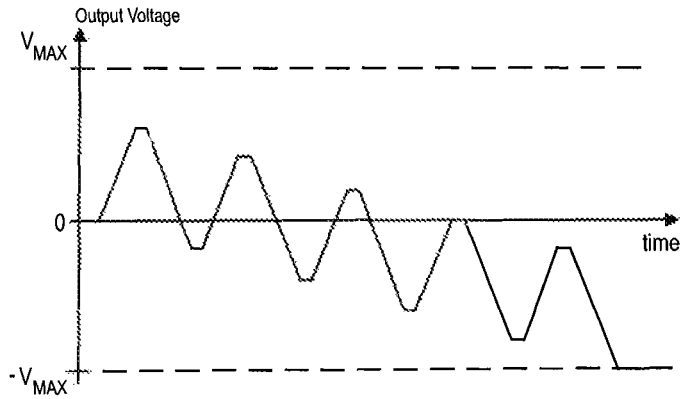
FIG. 3 shows a diagram of the output voltage.

Alternatingly adding and subtracting currents may be performed as shown in FIG. 3. If an additional current is to be added, the input means 11 is configured to receive the additional current, the cross-multiplexer 15 is configured to operate in direct mode, and the first 18 and second switching elements 110 are off so as to integrate the additional current flowing into the first 17 and second 19 capacitance.

Figure 4:
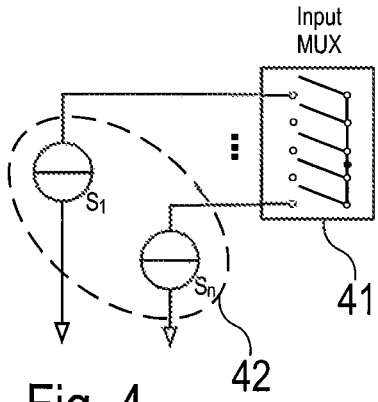
FIG. 4 shows a possible embodiment of the input means.

The overall processing time for one measurement is given by: $t_{TIA}[\text{clks}]=t_{up}[\text{clks}]+t_{is}[\text{clks}]+t_{ir}[\text{clks}]+t_{set,sub}[\text{clks}]$ In one embodiment, as shown in FIG. 4, the input means 11 comprises a multiplexer 41 being configured to selectively forward a current from a current source out of a plurality of current sources 42.

Figure 5:
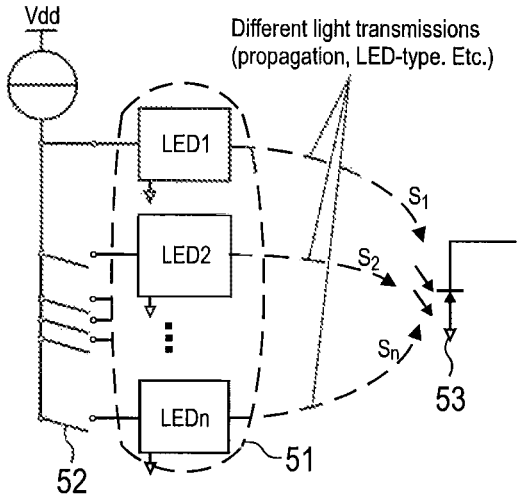
FIG. 5 shows an additional possible embodiment of the input means by employing light transmissions.

In one embodiment, as shown in FIG. 5, the input means 11 comprises a plurality of light emitting diodes 51, a switching element 52 being configured to selectively drive one light emitting diode out of the plurality of light emitting diodes 51, and a light sensitive element 53.

In one embodiment the circuit of FIG. 1 is employed for processing currents generated in an optical pixel-sensor array. In the optical pixel-sensor array, each sensor pixel generates a light-proportional current. Here, it can be required to build a sum of (e.g.) three adjacent pixel-cells (averaging) from which (e.g.) three times the current of the (e.g.) fourth adjacent pixel cell is subtracted (e.g., ambient offset compensation) for photo-quality processing, noise, or offset cancellation. In this embodiment, the (e.g.) four pixel cells are considered as being different kinds of photodiodes, detecting light of different spectral composition and wavelength regions.

Therefore, the required signal operation could (e.g.) be:

$$v_{out}=1\cdot I_1+1\cdot I_2+1\cdot I_3-3\cdot I_4$$

This operation can be realized in digital after four independent A-D conversions or using the proposed method in the analog domain where only one single A-D conversion is needed.

In one embodiment, the circuit depicted in FIG. 1 is employed for a scintillation counter system interpreting the radiation sum to get a measure for the overall level of radiation (originating from different sources) (e.g., in safety detectors in nuclear plants). Considering the example to have a detector system comprising (e.g.) three scintillation counters for alpha- and beta- and gamma-radiation. Again, the light flash reaction is detected by a photodiode. Here, the signal source is the radiation source, not the photo-diode. Due to the different effects of the individual radiation sources, the required overall radiation level may be defined to be e.g., 2 times the level of alpha-radiation plus 15 times the level of beta-radiation plus 20 times the level of detected gamma-radiation (factors arbitrarily chosen).

$$v_{out}=2\cdot I_1+15\cdot I_2+20\cdot I_3$$

Here again, each gain-factor could be determined by a temporally changed current-mirror-integration-time coefficient and setup. The method remains the same, however, even though the electrical source is only a single photo diode.

Using scintillation counters in medical imaging (positron emission tomography) would require the generation of a difference of signals originating from two scintillation counters.

$$v_{out}=a_1\cdot I_1-a_2\cdot I_2$$

This result carries the information about the energy of certain particles and radiation that has penetrated a certain tissue. Therefore, the thickness of this tissue layer can be extracted. Here, the proposed method could also be applied to generate the respective difference signal based on the scintillation counter reactions.

Beyond these potential examples, more or less any application can make use of the proposed analog addition/subtraction approach. The usefulness depends on the application's costs for a single A-D conversion and the constraint that analog signals are present and that these analog signals or their digitized equivalent need to be processed at some point.

Figure 6:
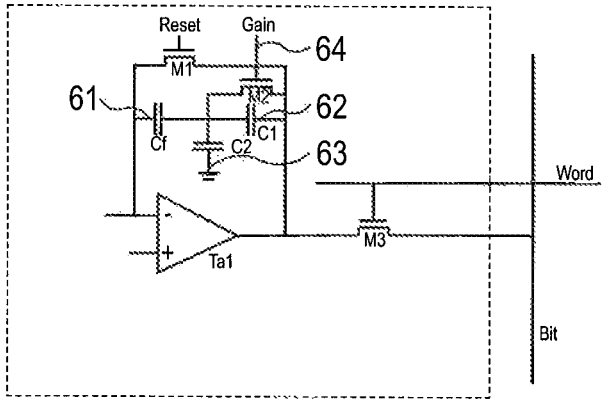
FIG. 6 shows an embodiment of the circuit with a capacitive voltage divider in the feed-back loop of the TIA.

In one embodiment, as shown in FIG. 6, the circuit also comprises a capacitive voltage divider in the feed-back loop of the TIA 6. The circuit further comprises a first 61, second 62, third 63, fourth, fifth, and sixth capacitor and a third 64 and fourth switching element. The first capacitance 17 consists of the first 61 and second 62 capacitor. One port of the third capacitor 63 is connected to the first 61 and second capacitor 62, and one port of the third capacitor 63 is connected to ground. The second capacitance consists of the fourth and fifth capacitor. One port of the sixth capacitor is connected to the fourth and fifth capacitor, and one port of the sixth capacitor is connected to ground. The third switching element 64 is arranged in parallel to the second capacitor 62, and the fourth switching element is in parallel with the fifth capacitor. In high gain mode, the third 64 and fourth switching elements are switched during reset so as to allow the capacitive voltage divider consisting of the second 62 and third 63 capacitor to operate during charge integration. Alternatively, in low gain mode, the third 64 and fourth switching elements are always on so as to short circuit the second 62 and fifth capacitor.

It is an advantage of the present invention that 100% of the dynamic range of the ADC is available for the desired difference of two (or) more input signals—the signal quality (accuracy, resolution) of the difference itself is not limited by the subtraction but only by the A-D conversion.

It is another advantage of the present invention that equivalent environmental signal offsets from the sensing element's environment are mainly compensated for inherently.

It is still another advantage of the present invention that only a single amplification and A-D conversion are required to obtain the desired signal difference. Overall power consumption to generate the difference is thereby reduced.

It is yet another advantage of the present invention that fewer gate-equivalents (transistors) and, hence, less area are required to implement the proposed method in comparison to state-of-the-art approaches.

It is a further advantage of the present invention that arbitrary additive and subtractive superposition of scaled input sources without limitation of the number of sources can be implemented. Again, a single A-D conversion will be sufficient to digitize the more complexly composed, resulting (desired) signal.

While the present invention has been illustrated and described in detail in the drawings and foregoing description, such illustration and description are to be considered illustrative or exemplary and not restrictive. It will be understood that changes and modifications may be made by those of ordinary skill within the scope and spirit of the following claims.

The invention claimed is:

1. Circuit comprising an input means configured to selectively receive a current from a plurality of currents; a first current mirror with mirror ratio m; a second current mirror; a third current mirror; a cross-multiplexer; a differential capacitive transimpedance amplifier having a first capacitance and a first switching element connected in parallel to a negative input port and a first output port of the differential capacitive transimpedance amplifier and a second capacitance and second switching element connected in parallel to a positive input port and a second output port of the differential capacitive transimpedance amplifier;

the input means being connected to an input port of the first current mirror;

an output port of the first current mirror being connected to input ports of the second and third current mirror;

an output port of the second current mirror being connected to a first input port of the cross-multiplexer; an output port of the third current mirror being connected to a second input port of the cross-multiplexer;

a first output port of the cross-multiplexer being connected to the negative input port of the differential capacitive transimpedance amplifier and a second output port of the cross-multiplexer being connected to the positive input port of the differential capacitive transimpedance amplifier;

the cross-multiplexer being configured either to establish a first current path between its first input port and its first output port and a second current path between its second input port and its second output port in direct mode or to establish a first current path between its first input port and its second output port and a second current path between its second input port and its first output port in reverse mode.

2. The circuit according to claim 1, wherein the first capacitance and the second capacitance are tunable devices or digitally programmable capacitance sub-circuits.

3. The circuit according to claim 1, wherein the input means comprises a multiplexer configured to selectively forward a current from a current source out of a plurality of current sources.

4. The circuit according to claim 1, wherein the input means comprises a plurality of light emitting diodes, a switching element configured to selectively drive one light emitting diode out of the plurality of light emitting diodes, and a light sensitive element.

5. The circuit according to claim 1, wherein an analog-to-digital converter is connected to an output port of the differential capacitive transimpedance amplifier.

6. The circuit according to claim 1, wherein the circuit further comprises a first, second, third, fourth, fifth and sixth capacitor and a third and fourth switching element; the first capacitance comprising the first and second capacitor, one port of the third capacitor being connected to the first and second capacitor and one port of the third capacitor being connected to ground; the second capacitance comprising the fourth and fifth capacitor, one port of the sixth capacitor being connected to the fourth and fifth capacitor and one port of the sixth capacitor being connected to ground, the third switching element being in parallel to the second capacitor and the fourth switching element being in parallel to the fifth capacitor.

7. Method for performing an arithmetic operation on a circuit according to claim 1, wherein the input means is configured to receive a first current, wherein the cross-multiplexer is configured to operate in direct mode and the first and second switching elements are off so as to integrate a first current flowing into the first and second capacitance; and wherein if a second current is to be added to the first current, the input means is configured to receive the second current, the cross-multiplexer is configured to operate in direct mode, and the first and second switching elements are off so as to integrate the second current flowing into the first and second capacitance; and if a second current is to be subtracted from the first current, the input means is configured to receive the second current, the cross-multiplexer is configured to operate in reverse mode, and the first and second switching elements are off so as to integrate with reverse polarity the second current flowing into the first and second capacitance.

8. Method according to claim 7, wherein an output of the differential capacitive transimpedance amplifier is digitized by an analog-to-digital converter.

9. Method according to claim 7, wherein the first and second switching elements are switched during reset.

10. Method for performing an arithmetic operation on a circuit according to claim 6, wherein in high gain mode, the third and fourth switching elements are switched during reset so as to allow a capacitive voltage divider including the second (and third capacitor to operate during charge integration; or in low gain mode, the third and fourth switching elements are always on so as to short circuit the second and fifth capacitor.

* * * * *